US008031877B2

(12) United States Patent
Yamaguchi

(10) Patent No.: US 8,031,877 B2
(45) Date of Patent: Oct. 4, 2011

(54) IN-VEHICLE COMMUNICATION SYSTEM

(75) Inventor: Katsuhiro Yamaguchi, Osaka (JP)

(73) Assignee: Panasonic Corporation, Osaka (JP)

( * ) Notice: Subject to any disclaimer, the term of this patent is extended or adjusted under 35 U.S.C. 154(b) by 949 days.

(21) Appl. No.: 11/911,389

(22) PCT Filed: Jun. 15, 2006

(86) PCT No.: PCT/JP2006/311989

§ 371 (c)(1),
(2), (4) Date: Oct. 12, 2007

(87) PCT Pub. No.: WO2007/000897

PCT Pub. Date: Jan. 4, 2007

(65) Prior Publication Data

US 2009/0022333 A1 Jan. 22, 2009

(30) Foreign Application Priority Data

Jun. 27, 2005 (JP) ..... 2005-185851

(51) Int. Cl.
*G10K 11/16* (2006.01)

(52) U.S. Cl. ..... 381/71.4; 381/71.2; 381/71.11; 701/7; 701/36

(58) Field of Classification Search ..... 381/71.4, 381/71.2, 71.11; 701/7, 36
See application file for complete search history.

(56) References Cited

U.S. PATENT DOCUMENTS

| | | | | |
|---|---|---|---|---|
| 5,245,664 | A * | 9/1993 | Kinoshite et al. | 381/71.4 |
| 5,373,288 | A | 12/1994 | Blahut | |
| 2001/0025376 | A1 | 9/2001 | Knobl | |
| 2005/0036631 | A1 | 2/2005 | Feit et al. | |
| 2005/0222719 | A1 * | 10/2005 | Fukuro | 701/1 |

FOREIGN PATENT DOCUMENTS

| | | | |
|---|---|---|---|
| JP | 11-052959 | A | 2/1999 |
| JP | 2003-259500 | A | 9/2003 |
| JP | 2003-274496 | A | 9/2003 |
| JP | 2005-513935 | A | 5/2005 |
| JP | 2005-236502 | A | 9/2005 |
| JP | 2005-539409 | A | 12/2005 |
| WO | WO 97/27724 | A1 | 7/1997 |
| WO | WO 03/055272 | A1 | 7/2003 |
| WO | WO 03/075125 | A3 | 9/2003 |

OTHER PUBLICATIONS

International Search Report for Application No. PCT/JP2006/311989, dated Aug. 15, 2006.
Supplementary European Search Report for Application No. EP 06 75 7337, Nov. 9, 2010, Panasonic Corporation.

* cited by examiner

*Primary Examiner* — Thinh T Nguyen
(74) *Attorney, Agent, or Firm* — RatnerPrestia

(57) ABSTRACT

An in-vehicle communication system includes a control unit which locates coupling points of each one of active speaker units to in-vehicle network. The plurality of the active speaker units includes a plurality of acoustic characteristics set data and programs for determining their own addresses. The respective active speaker units thus can be coupled to in-vehicle network without changing their software, and acoustic characteristics values in response to their coupling points in the vehicle can be established.

8 Claims, 9 Drawing Sheets

FIG. 3

Device table

T1

| ID (data input value) | Device information | Device attribute | Group address |
|---|---|---|---|
| A | Active speaker unit | FR | α |
| B | Active speaker unit | RR | α |
| C | Active speaker unit | RL | α |
| D | Active speaker unit | FL | α |

Measured information table

T2

| Tentative address | ID | Device information | Communication response time |
|---|---|---|---|
| (1) | (D) | Active speaker unit | (·····) |
| (2) | (C) | Active speaker unit | (·····) |
| (3) | (B) | Active speaker unit | (·····) |
| (4) | (A) | Active speaker unit | (·····) |

FIG. 11

Device table T11

| ID | Device information | Device attribute | Sound pressure level | Group address |
|---|---|---|---|---|
| | Active speaker unit | FR | ····· | α |
| | Active speaker unit | RR | ····· | α |
| | Active speaker unit | RL | ····· | α |
| | Active speaker unit | FL | ····· | α |

Measured information table T12

| Tentative address | Measured sound pressure level |
|---|---|
| | |
| | |
| | |
| | |

IN-VEHICLE COMMUNICATION SYSTEM

THIS APPLICATION IS A U.S. NATIONAL PHASE APPLICATION OF PCT INTERNATIONAL APPLICATION PCT/JP2006/311989.

TECHNICAL FIELD

The present invention relates to an in-vehicle communication system, and more particularly it relates to a device for connecting a plurality of audio reproducing apparatuses to the in-vehicle communication system.

BACKGROUND ART

Unexamined Japanese Patent Publication No. 2003-274496 discloses a device for setting acoustic characteristics of audio reproducing apparatuses in response to a placement of speakers in a vehicle and characteristics of the speakers. The disclosed device is an acoustic field setting device which provides the audio reproducing apparatus with a network interface or a card interface, and characteristics data of the speakers or information about the placement of the speakers in the vehicle are supplied from the outside of the vehicle, so that an optimum acoustic characteristics can be set.

However, the foregoing document does not disclose a specific method of determining the placement of the speakers in the vehicle, and all the speakers installed are connected to a single audio reproducing apparatus, then the acoustic characteristics of each one of the speakers are determined.

The vehicle recently has encountered two problems, namely, (a) increasing weight due to an increment of harness and (b) a lack of space to accommodate the increased harness. A conventional in-vehicle communication system employs active speaker units which integrate audio reproducing apparatuses with speakers for saving the electrical wiring. This configuration however needs software appropriate for each one of the speakers in order to set acoustic characteristics proper to the respective speakers. Some in-vehicle network needs providing the respective audio reproducing apparatuses with an address in advance, so that the speakers are obliged to have different product numbers from each other because they integrate different software although they look like identical ones.

DISCLOSURE OF INVENTION

An in-vehicle communication system comprises a plurality of active speaker units, a control unit, and a given in-vehicle network for coupling the active speaker units to the control unit. The control unit includes a program which locates respective coupling points of the active speaker units to the in-vehicle network and another program which notifies the speaker units of the coupling points at the vehicle through a given method. The plurality of active speaker units include a plurality of acoustic characteristics set data, a program for determining and setting acoustic characteristics set values based on the coupling points, a group address common to the respective active speaker units, and another program which determines tentative addresses recognizable in the communications between the active speaker units before storing the tentative addresses their own tentative addresses.

The foregoing structure allows the control unit of the in-vehicle communication system to locate the coupling points of the respective speaker units and notify the speaker units of their coupling points. Use of the obtained tentative addresses allows each one of the respective active speaker units to recognize a command, supplied through the in-vehicle network, as the command addressed to itself, and to set the data, specified among plural acoustic characteristics data, as its own acoustic characteristics. The foregoing structure thus advantageously saves preparing the software which includes different addresses as well as acoustic characteristics for the respective active speaker units.

BRIEF DESCRIPTION OF DRAWINGS

FIG. 3 shows tables listing data stored in a control unit in accordance with the first embodiment.

FIG. 11 shows tables which list data stored in a control unit in accordance with the second embodiment.

DESCRIPTIONS OF REFERENCE MARKS

Figure 1:
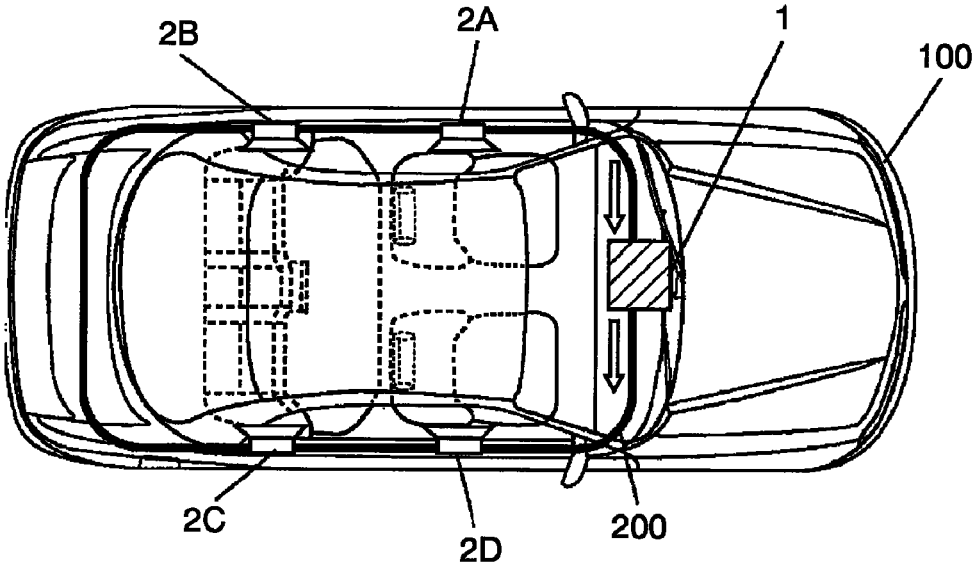
FIG. 1 shows a structure of an in-vehicle communication system in accordance with a first embodiment of the present invention.

1 control unit
2A, 2B, 2C, 2D, 20A, 20B, 20C, 20D active speaker unit
11 control unit
12 microphone
13 audio signal outputting device
20 speaker
21 amplifier
22 audio controller
23 aural signal inputting section
24 communication interface (communication I/F)
25 microprocessor
26 memory
100, 101 vehicle
200, 201 in-vehicle network

DETAILED DESCRIPTION OF PREFERRED EMBODIMENTS

Embodiment 1

The first exemplary embodiment of the present invention is demonstrated hereinafter with reference to some of the accompanying drawings. FIG. 1 shows a structure of an in-vehicle communication system in accordance with the first embodiment of the present invention. As shown in FIG. 1, vehicle 100 is equipped with ring-shaped topology in-vehicle network 200. Vehicle 100 includes control unit 1 at its front, and active speaker units 2A, 2B, 2C and 2D at its front left (hereinafter referred to as FL), rear left (RL), rear right (RR) and front right (FR). These devices are coupled to in-vehicle network 200. Data input/output section (not shown in FIG. 1) outputs data along the coupling direction of speaker unit 2D as shown with arrow marks in FIG. 1, and the data supplied circulates through speaker units 2D, 2C, 2B and 2A in this order as the shape of the network tells, then is fed into control unit 1.

Figure 2:
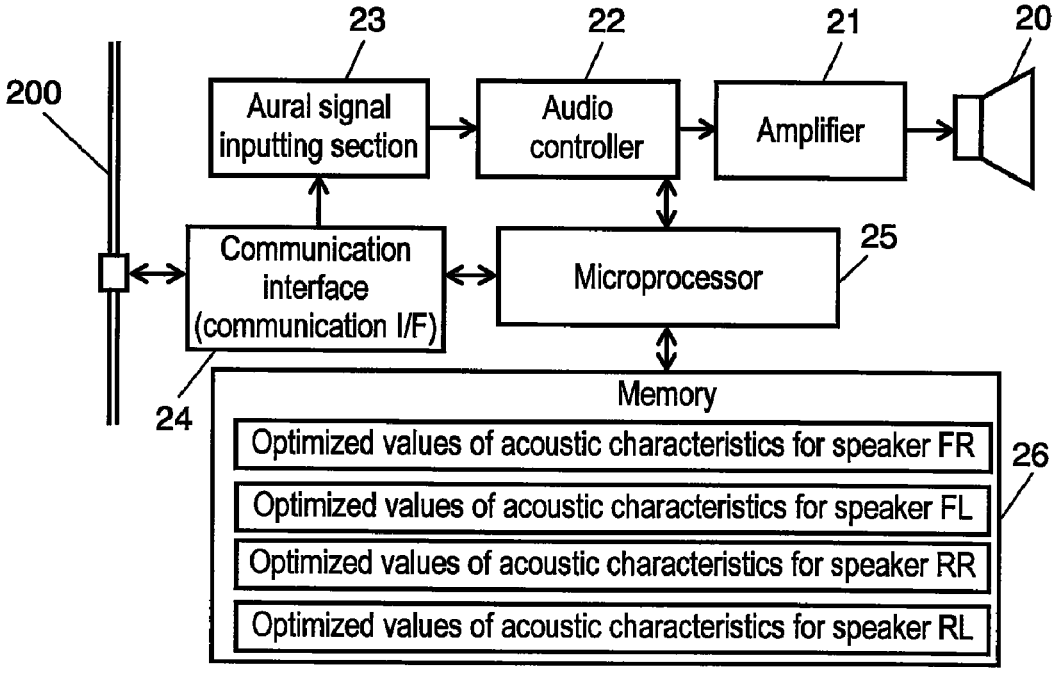
FIG. 2 shows a block diagram illustrating a structure of an active speaker unit in accordance with the first embodiment.

FIG. 2 shows a block diagram illustrating a structure of the active speaker unit. As shown in FIG. 2, active speaker units 2A, 2B, 2C and 2D receive or transmit data from or to network 200 through communication I/F 24. Aural signal data is supplied to aural signal inputting section 23, and runs through acoustic controller 22, amplifier 21 before the data is output from speaker 20. Command data is supplied to microprocessor 25 so that given programs can implement processes. Memory 26 stores optimized values of acoustic characteristics in advance for the speakers placed at FR, RL, RR, and RL.

FIG. 3 shows tables listing data stored in the control unit in accordance with the first embodiment. As shown in FIG. 3, device table T1 includes the information about the devices coupled to network 200. To be more specific, the column of ID (values of input data) shows the sequence of data supplied from control unit 1. In this first embodiment, the devices refer to active speaker units 2A, 2B, 2C and 2D, and the columns of device information list the active speaker units and their names. The columns of device attribute list the information proper to the devices. To be more specific, as the coupling points of speaker units 2A, 2B, 2C and 2D are marked with FR, RR and so on, "FR", "RR" and others are stored. As a group address, address a common to the foregoing speaker units is stored; however, this first embodiment does not necessarily store address α to be related to other data in device table 1, but it can be stored separately.

Measured information table T2 includes tentative addresses of the respective active speaker units 2A, 2B, 2C and 2D, and response times needed in communication by those speaker units. The tentative addresses are detailed later.

Figure 4:
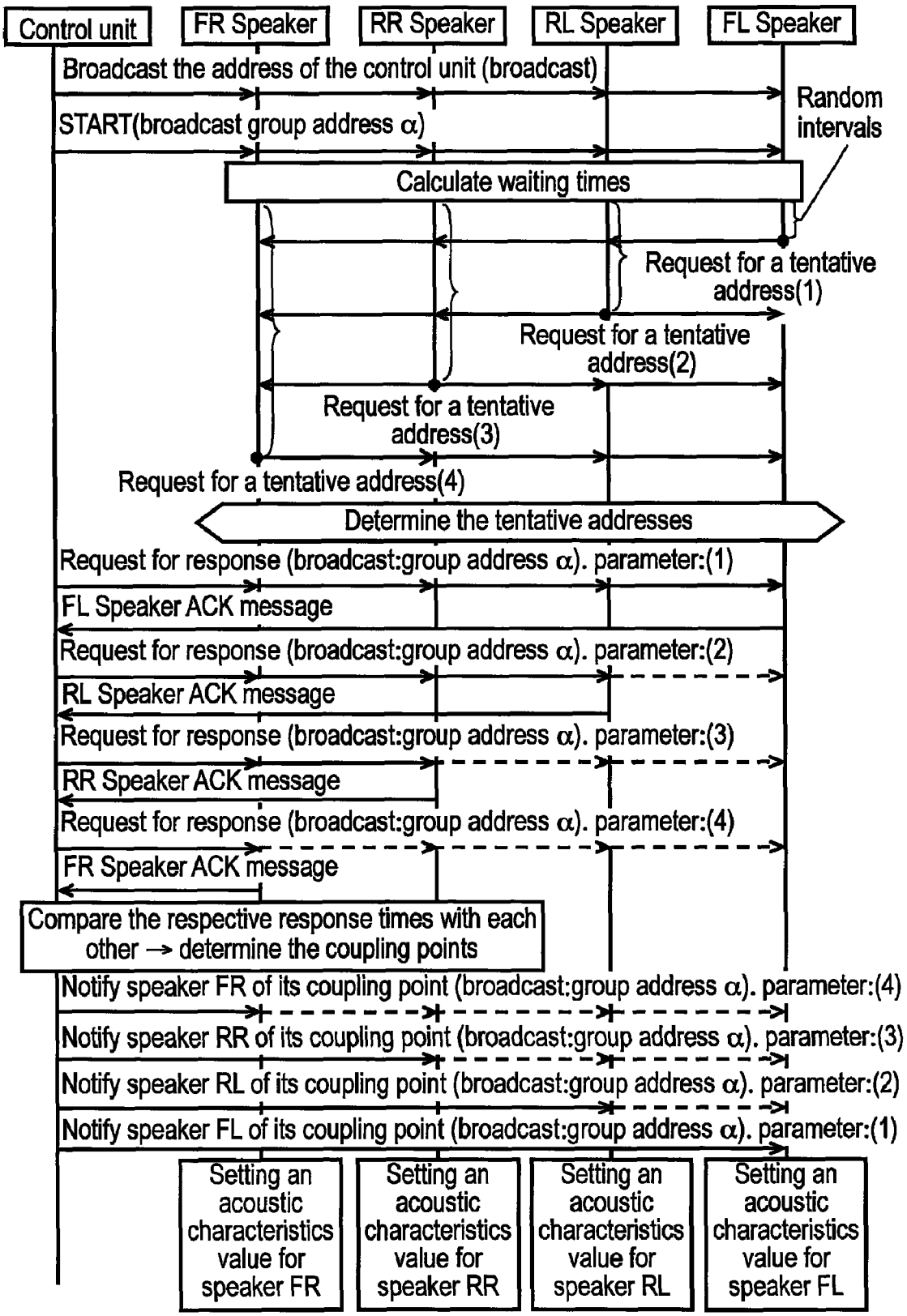
FIG. 4 shows a protocol of the in-vehicle communication system in accordance with the first embodiment.

Specific operation of the in-vehicle communication system discussed above is demonstrated hereinafter with reference to FIG. 4-FIG. 9. FIG. 4 shows a protocol of the in-vehicle communication system in accordance with the first embodiment. When four active speaker units 2A-2D shown in FIG. 1 are coupled to in-vehicle network 200, this protocol is implemented through network 200. In FIG. 4, active speaker unit 2A is referred to as FL speaker, and speaker units 2B, 2C, and 2D are referred to as RL speaker, RR speaker units and FR speaker unit respectively.

Figure 5:
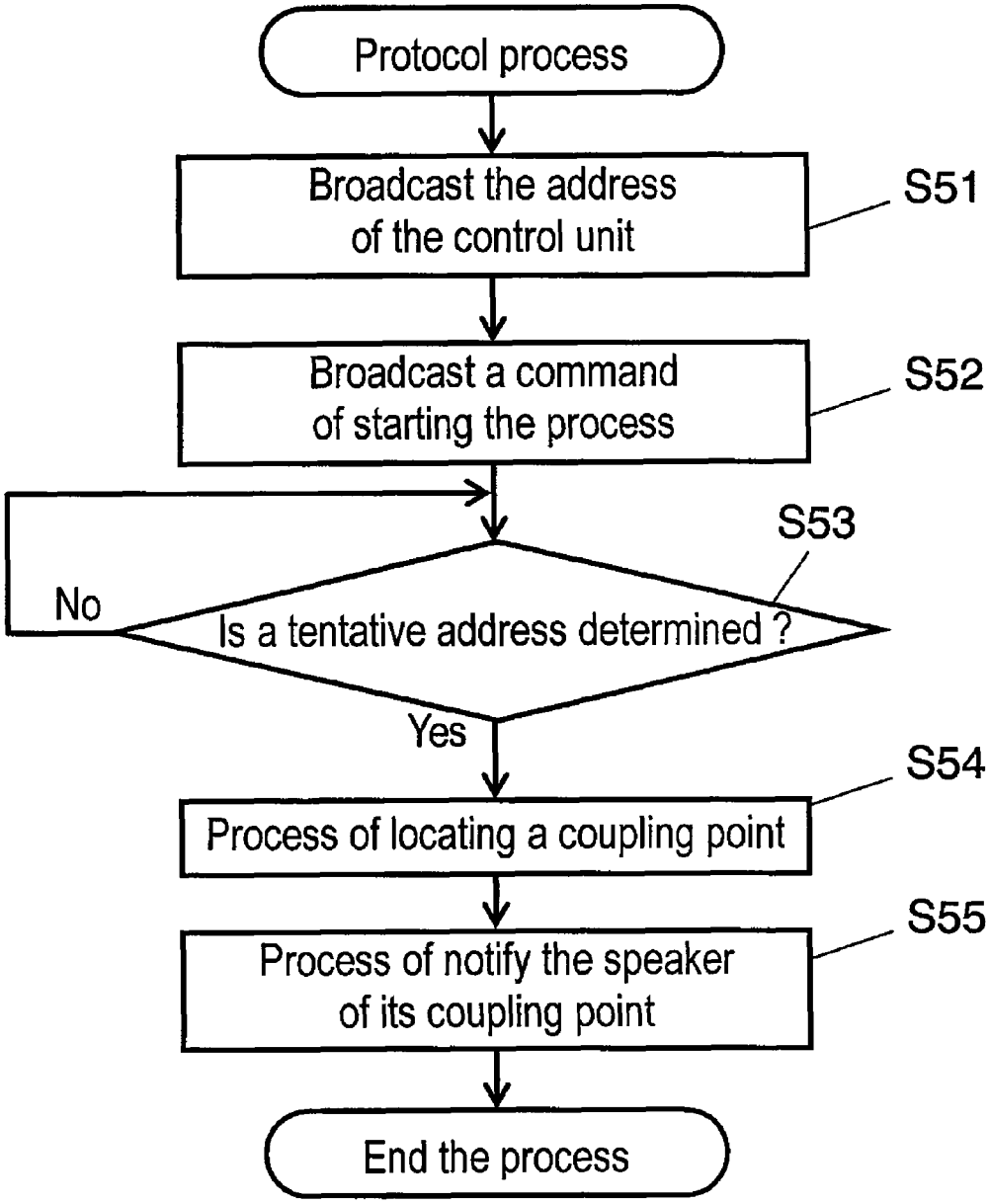
FIG. 5 shows a flowchart illustrating a communication program carried out by the control unit in accordance with the first embodiment.
Figure 6:
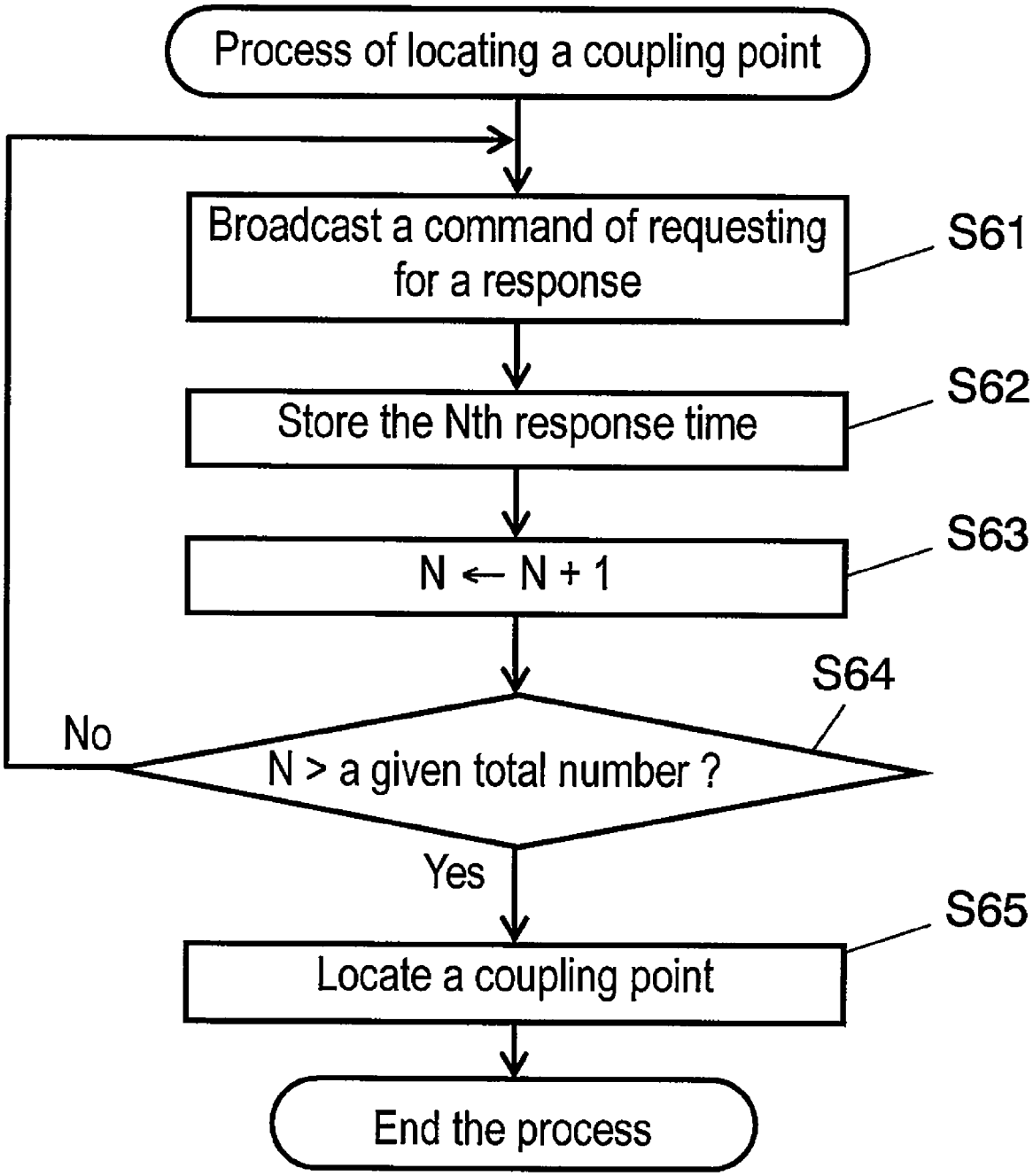
FIG. 6 shows a flowchart of a program implemented by the control unit to locate the coupling points of respective active speaker units in accordance with the first embodiment.
Figure 7:
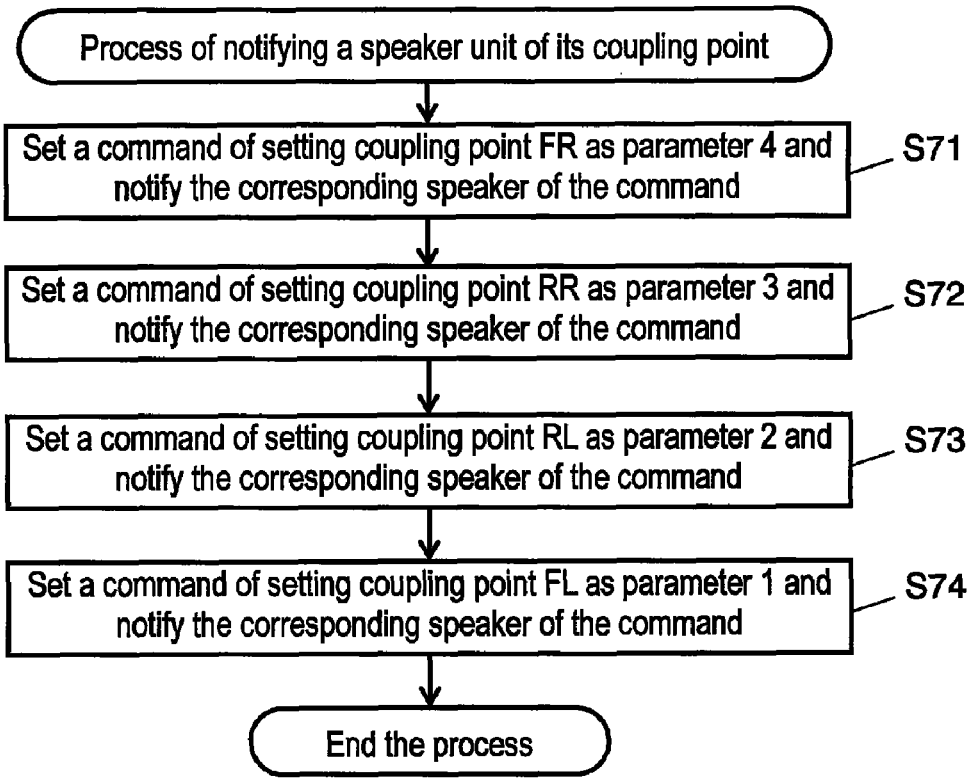
FIG. 7 shows a flowchart illustrating a program implemented by the control unit to notify the respective active speaker units of their coupling points.

FIGS. 5, 6, and 7 show flowcharts illustrating the communication programs in accordance with the first embodiments. FIG. 5 shows a flowchart illustrating a communication program carried out by the control unit in accordance with the first embodiment. FIG. 6 shows a flowchart of a program implemented by the control unit to locate the coupling points of respective active speaker units in accordance with the first embodiment, to be more specific, it details the process in S54 shown in FIG. 5. FIG. 7 shows a flowchart illustrating a program implemented by the control unit to notify the respective active speaker units of their coupling points, to be more specific, it details the process of S55 shown in FIG. 5.

Figure 8:
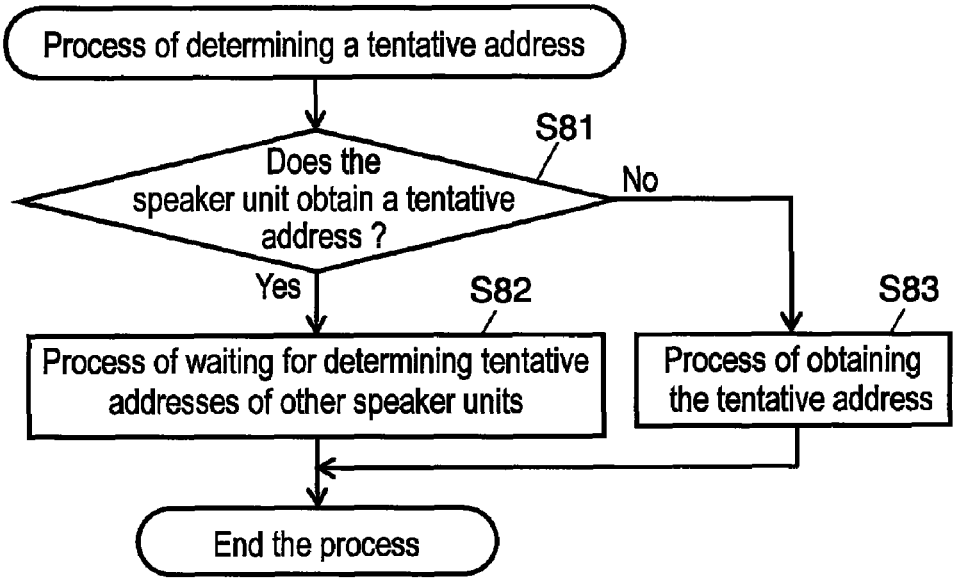
FIG. 8 shows a flowchart illustrating a program implemented by the active speaker unit in accordance with the first embodiment for determining a tentative address.
Figure 9:
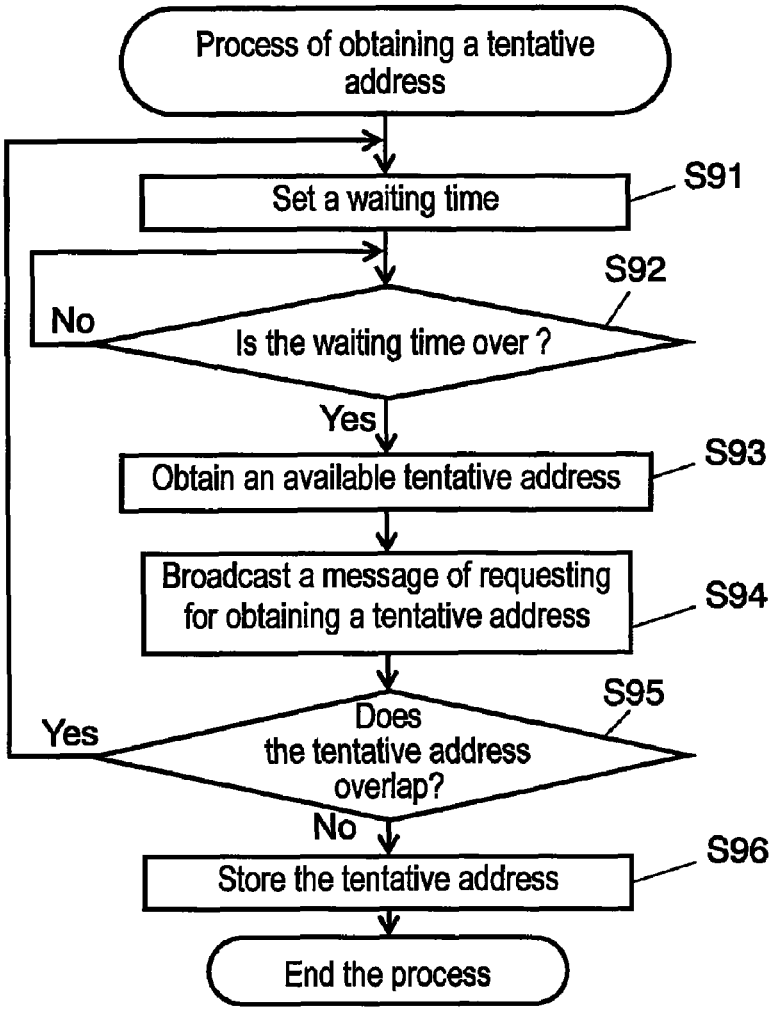
FIG. 9 shows a flowchart illustrating a program implemented by the active speaker unit in accordance with the first embodiment for obtaining a tentative address.

FIGS. 8 and 9 show flowcharts illustrating the communication programs of active speaker units 2A, 2B, 2C and 2D. FIG. 8 shows a flowchart illustrating a program implemented by the active speaker units in accordance with the first embodiment for determining their tentative addresses. FIG. 9 shows a flowchart illustrating a program implemented by the active speaker units in accordance with the first embodiment for obtaining their tentative addresses, to be more specific, it details the process of S83 shown in FIG. 8.

The process in control unit 1 is firstly described with reference to FIG. 1-FIG. 7. As shown in FIG. 1, control unit 1 broadcasts its own address to all of the devices coupled to network 200, then starts communication, locates the coupling points of active speaker units 2A, 2B, 2C, and 2D, and notifies the speaker units of their coupling points. This process is detailed hereinafter with reference to the flowcharts.

Control unit 1 starts running the program for implementing the protocol as shown in FIG. 5. First, control unit 1 broadcasts its own address to all the devices coupled to in-vehicle network 200 (S51), so that the devices can transmit data to control unit 1. Then control unit 1 broadcasts a starting command for implementing a series of protocols to group address a listed in device table T1 shown in FIG. 3 (S52).

Respective active speaker units 2A, 2B, 2C and 2D are set to receive a command about group address α. The respective speaker units receive the starting command, and then implement communication and manipulation among themselves following a tentative address determining program. The tentative address determining process is detailed later with reference to FIG. 8.

During the foregoing process of the speaker units, control unit 1 confirms whether or not the tentative addresses of the speaker units are determined (S53). If the tentative addresses are not yet determined (No), the loop is repeated until the addresses are determined (Yes). After the determination, control unit 1 starts the process of locating the coupling points of the respective speaker units (S54). The way of locating the coupling points is described with reference to FIG. 6. Control unit 1 broadcasts a response requesting command as parameter N=1 to group address α (S61).

Each one of active speaker units 2A, 2B, 2C and 2D receives the response requesting command, and only speaker unit 2A placed at FL returns a response message, because its tentative address is equal to parameter N=1. Control unit 1 stores the time period when it receives this response message as a communication response time. Although it is not shown in FIG. 4 or FIG. 6, each one of the speaker units is designed such that reception of the response requesting command prompts the speaker units to return the response message at given intervals and in given number of times, and a total communication response time is calculated. Then differences between the response times of the respective speaker units can be recognized more clearly. Determination of the communication response time prompts measured information table T2 shown in FIG. 3 to store tentative address N=1 and the obtained response time (S62). As discussed above, the program for locating the coupling points of the active speaker units coupled to in-vehicle network 200 respectively can detect the differences between the response times taken from the data input/output section in control unit 1 to each one of the speaker units. The coupling points of each one of the active speaker units thus can be located by detecting the differences between the response times.

Then the same process is repeated to tentative addresses N=2, 3 and 4 for obtaining the response times from every speaker unit by referring to these tentative addresses. For this purpose, parameter N has an additional one, i.e. N=N+1 (S63). It is confirmed whether or not parameter N is a greater number than the given total number of active speaker units 2A, 2B, 2C and 2D (S64). When parameter N is smaller than or equal to the given total number (No), the process returns to S61 for repeating the loop. When parameter N is greater than the given total number (Yes), the step moves on to the next step (S65).

In the case of the ring network shown in FIG. 1, the differences between the response times of respective active speaker units 2A, 2B, 2C and 2D depend largely on the delay of reading data through the interface which couples respective devices to the ring network and the delay produced by electrical amplification, rather than the physical distance from the speaker units to the data input/output section of control unit 1. In this first embodiment, each one of active speaker units FR, RR, RL, FL shown in FIG. 1 has a longer response time in this order.

The preceding discussion proves that device table T1 shown in FIG. 3 tells the order of coupling active speaker units 2A, 2B, 2C and 2D to network 200, so that measured information table T2 can uniquely identify the tentative address and the data input value (ID). The result of this first embodiment is shown in parentheses on table T2.

Control unit 1 thus locates the coupling points of active speaker units 2A, 2B, 2C and 2D (S65), then it notifies the speaker units of the information about the located coupling points (S55).

The notification process of the coupled points to the speaker units is described hereinafter with reference to FIG. 7. In this process, the respective device attribute information shown in table T1 and the tentative addresses shown in table T2 are broadcasted as parameters to group address a sequentially (S71-S74). In other words, control unit 1 notifies the coupling points in vehicle 100 to a plurality of active speaker units 2A, 2B, 2C and 2D having group address a by using the tentative addresses of the respective speaker units as parameters.

The foregoing process allows the respective speaker units to obtain the device attribute information fit for their own tentative addresses, so that acoustic characteristics set values appropriate to the coupling points in vehicle 100 can be established.

Next, the determination of tentative addresses of active speaker units 2A, 2B, 2C and 2D is described with reference to FIG. 4, FIG. 8 and FIG. 9. As shown in FIG. 8, this process recognizes whether or not the tentative address has been obtained (S81), and when the address has been obtained (Yes), the process waits for a determination of a tentative address of another active speaker unit (S82). When the tentative address is not obtained yet (No), the process carries out obtaining the tentative address (S83).

The foregoing determination process is further described with reference to FIG. 9. As shown in FIG. 9, the process sets waiting times at random (S91), and waits until the waiting times are over (S92). To be more specific, when the waiting times are not over (No), step S92 is repeated. When the waiting times are over (Yes), the process moves on to next step (S93).

In the instance shown in FIG. 4, speaker unit 2A coupled at point FL (referred to as "FL Speaker" in the drawing) starts requesting for obtaining the tentative address firstly among speaker units 2A, 2B, 2C and 2D. FL speaker unit 2A uses an initial tentative address "1", and broadcasts a message of requesting for obtaining the tentative address to group address a using parameter "1" (S94). This message teaches other active speaker units 2B, 2C and 2D that FL speaker unit 2A obtains tentative address "1", so that the next obtainable tentative address is "2". Then speaker units 2B, 2C and 2D coupled at point RL, RR, and FR do the same process for obtaining their own tentative addresses. The respective speaker units request obtaining a tentative address at random intervals, so that the four speaker units scarcely request it at one time. However, the requests can be overlapped, in other words, one of other remaining speaker units requests the same address value as the received one, or receives the same address value twice. To prevent this overlapping, the process needs to confirm whether or not the tentative address is overlapped (S95). When the overlap exists (Yes), the value becomes invalid and the process returns to the step of setting a random waiting time (S91). When no overlap exists (No), the tentative address is stored (S96).

The tentative addresses of each one of active speaker units 2A, 2B, 2C and 2D are thus determined recognizable uniquely among the respective speaker units, and the number of the addresses is not greater than the total number of the speaker units coupled to in-vehicle network 200, and yet the addresses are in running numbers.

In this first embodiment, the devices coupled to network 200 are only speaker units 2A, 2B, 2C and 2D; however, other devices can be coupled thereto, and placement of those other devices between the respective speaker units allows clarifying the difference in response time more clearly. The devices are not limited to audio reproducing apparatuses, but they can be any apparatus, such as an AV receiver, as long as they can be coupled to the network.

As discussed above, the in-vehicle communication system in accordance with this first embodiment comprises the following elements:

a plurality of active speaker units 2A, 2B, 2C and 2D;

control unit 1; and in-vehicle network 200 to which the active speaker units and control unit 1 are coupled.

Control unit 1 includes:

a program for locating the coupling points of the respective speaker units; and another program for notifying the speaker units of their coupling points at vehicle 100 through a given method.

The plurality of speaker units include:

a plurality of acoustic characteristics set data, a program for determining and setting acoustic characteristics set values based on the coupling points, a group address common to the respective speaker units, a program for determining tentative addresses recognizable and communicable among the speaker units, and storing the tentative addresses as their own ones through a given method.

The foregoing structure allows control unit 1 to locate the coupling points of the active speaker units, and notifies them of their coupling points. The respective speaker units recognize commands, which are issued through network 200 and addressed to themselves, by using the tentative addresses obtained, and select stipulated data and set that data as their own acoustic characteristics out of the plurality of acoustic characteristics set data. Thus there is advantageously no need to prepare the software having different addresses and acoustic characteristics for the respective speaker units.

Embodiment 2

Figure 10:
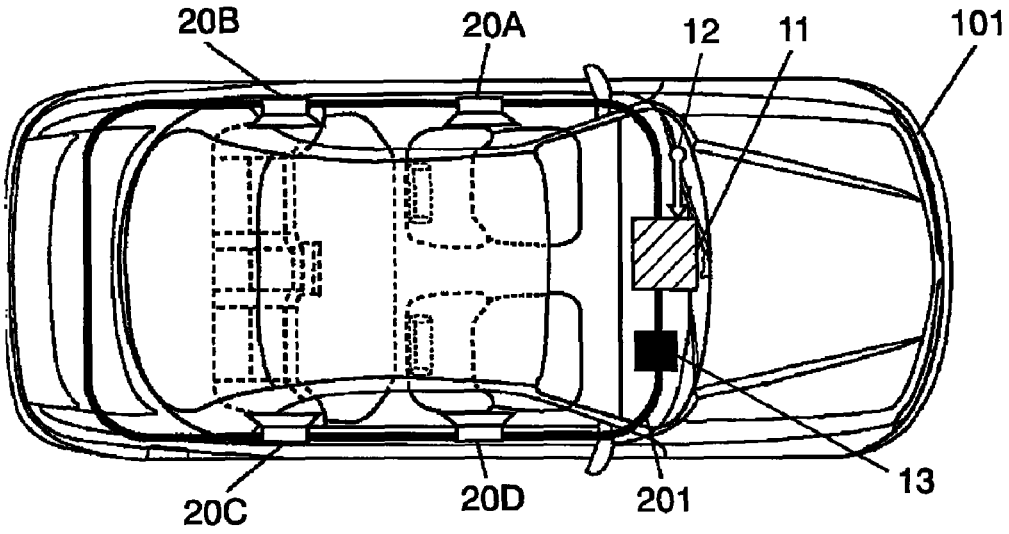
FIG. 10 shows a structure of an in-vehicle communication system in accordance with a second embodiment of the present invention.

The second exemplary embodiment is demonstrated hereinafter with reference to some of the accompanying drawings. FIG. 10 shows a structure of an in-vehicle communication system in accordance with the second embodiment. This in-vehicle communication system additionally includes audio signal outputting device 13 and microphone 12 which is coupled to control unit 11, besides the elements of the in-vehicle communication system in accordance with the first embodiment.

As shown in FIG. 10, vehicle 101 is equipped with ring-shaped topology in-vehicle network 201. Vehicle 101 includes control unit 11 and audio signal outputting device 13 at its front, microphone 12 coupled to control unit 11 and placed in front of the front seat, and active speaker units 20A, 20B, 20C and 20D at its front left (hereinafter referred to as FL), rear left (RL), rear right (RR) and front right (FR) respectively. These speaker units are coupled to in-vehicle network 201. An audio signal supplied from audio signal outputting device 13 is fed into the respective speaker units through network 201.

The active speaker units have the same construction as those shown in FIG. 2, and control unit 11 includes a sound pressure measuring circuit which extracts a sound level of a predetermined frequency band from aural signals supplied from microphone 12. Meanwhile the sound pressure level can be measured by using software in part. The foregoing structure allows control unit 11 to collect the sound generated by each one of the speaker units through microphone 12, thereby extracting the sound pressure level of the predetermined frequency band.

FIG. 11 shows an instance of the data stored in control unit 11 in accordance with the second embodiment. As shown in FIG. 11, device table T11 includes information about the devices coupled to the in-vehicle network. The information contains additionally an item of a sound pressure level besides the items described in the first embodiment such as IDs which identify the respective speaker units. This new item includes sound pressure data of the frequency band, which data is to be measured by microphone 12 when the respective speaker units reproduce a given test audio signal. The respective speaker units and microphone 12 have been placed in advance at the points shown in FIG. 10. In this second embodiment, the test audio signal comes from the middle and high frequency bands. Use of the test audio signal in this range allows differentiating input sound pressures from each other with ease, which input sound pressures are obtained from the respective speaker units. Because the use of test audio signal in the foregoing frequency band allows easily and clearly discriminating the attenuation levels due to the difference in travel-distances of the reproduced sound from the coupling points of speaker units 2A, 2B, 2C and 2D to microphone 12. The guideline of adequate frequency band for the test audio signal ranges from 400 Hz to 12 kHz; however, the test signal is not limited within this range. Device table T11 stores address α as a group address common to the respective speaker units. It is not necessary for table T11 to store this address to be associated with other data, but this address can be separately stored from the other data. Measured information table T12 stores tentative addresses obtained by the respective speaker units and the measured sound pressure data as the table T2 in the first embodiment does.

Figure 12:
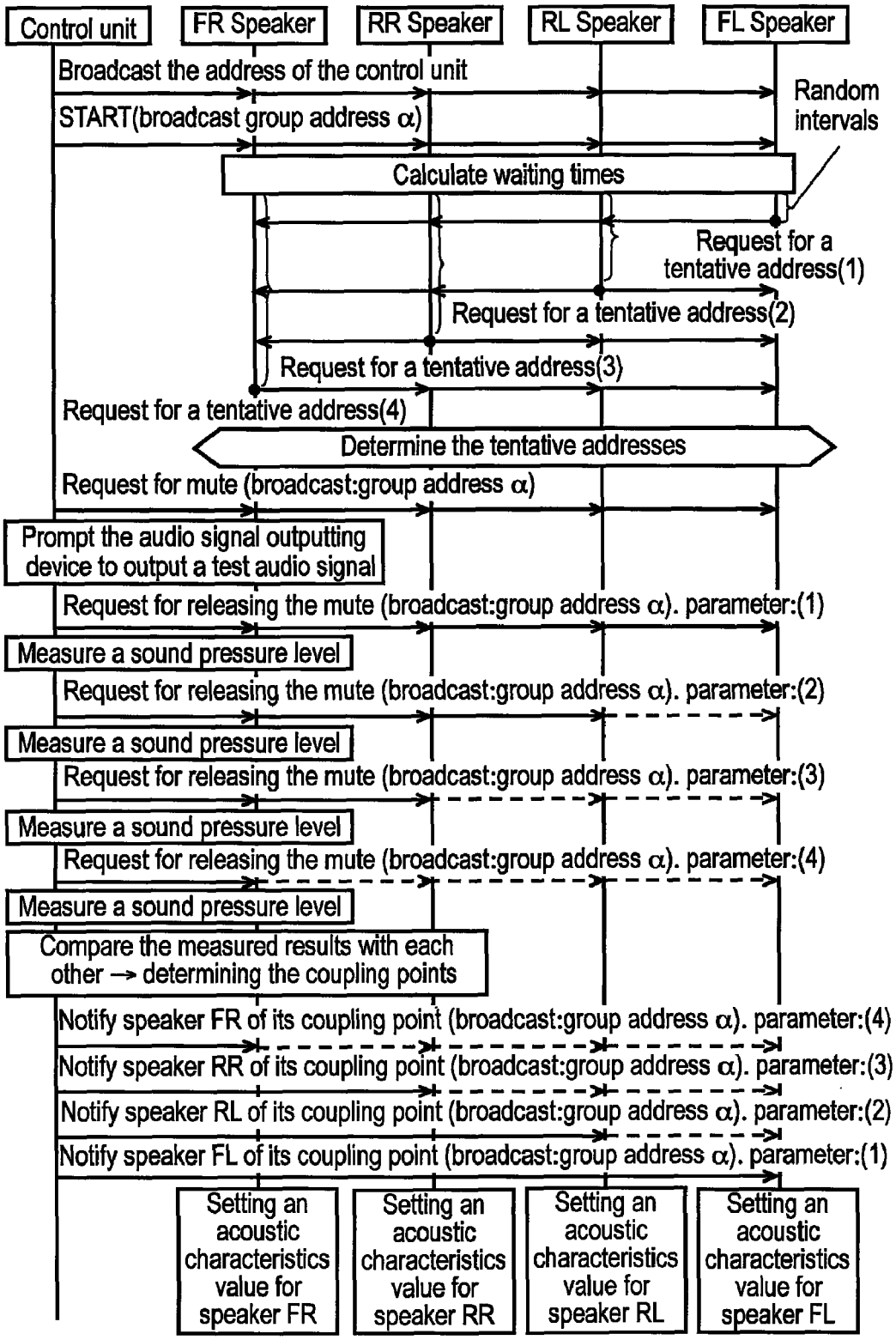
FIG. 12 shows a protocol of the in-vehicle communication system in accordance with the second embodiment.

A specific operation in the foregoing structure is demonstrated hereinafter with reference to some of the accompanying drawings. FIG. 12 shows a protocol of the in-vehicle communication system in accordance with the second embodiment. In FIG. 12, respective active speaker units 20A, 20B, 20C and 20D are referred to as FL Speaker, RL Speaker, RR Speaker, and FR speaker.

First, control unit 11 broadcasts its own address to all the devices coupled to in-vehicle network 201, so that the devices can transmit data to control unit 11. Then control unit 11 broadcasts a starting command for implementing a series of protocols to group address α listed in device table T11 shown in FIG. 11. Tentative addresses, corresponding to the starting command, of the respective speaker units can be determined in the same way as described in the first embodiment, thus the description thereof is omitted here. After the determination of the tentative addresses, control unit 11 broadcasts a mute request for muting the active speaker units to group address α. Next, control unit 11 prompts audio signal outputting device 13 to output a test audio signal to in-vehicle network 201.

Then control unit 11 uses a request for releasing the mute as a parameter, thereby setting tentative address "1", and broadcasts the tentative address to group address α. The active speaker unit having the tentative address "1" reproduces the sound of the test audio signal, and control unit 11 collects this sound through microphone 12, and extracts a given frequency level through the sound pressure level measuring circuit. The extracted frequency level and the tentative address are stored in measured information table T12. In a similar way, sound pressure levels of remaining speaker units having tentative addresses 2-4 are measured. After every sound pressure level is measured, the tentative addresses are set as IDs of device table T11 by using the sound pressure levels stored in table T11 and the measured sound pressure levels stored in table 12, so that the coupling points corresponding to the tentative addresses can be determined. After this, using the tentative addresses as parameters, control unit 11 notifies the respective speaker units of their own coupling points. This is also done similarly in the first embodiment.

In the previous embodiments, a ring-shaped topology in-vehicle network is used; however, a bus topology in-vehicle network can work with a protocol similar to the one used in the previous embodiments. The first and the second embodiments can be combined together for locating the coupling points of the respective active speaker units.

INDUSTRIAL APPLICABILITY

An in-vehicle communication system of the present invention can be useful for the software built-in a plurality of active speaker units coupled to an in-vehicle network and also for the coupling process to the network.

The invention claimed is:

1. An in-vehicle communication system comprising:

a plurality of active speaker units, a control unit, and a given in-vehicle network to which the active speaker units and the control unit are coupled, wherein the control unit includes:

a program for locating coupling points of respective active speaker units at the in-vehicle network; and a program for notifying the speaker units of their coupling points at the vehicle through a given method, wherein the plurality of active speaker units includes:

a plurality of acoustic characteristics set data;

a program for determining and setting acoustic characteristics set values based on the coupling points;

a group address common to the active speaker units; and a program for implementing communications between the active speaker units, determining tentative addresses recognizable between the active speaker units through a given method, and storing the tentative addresses as their own addresses.

2. The in-vehicle communication system of claim 1, wherein the given in-vehicle network forms a ring topology.

3. The in-vehicle communication system of claim 1, wherein the program for locating coupling points of the respective active speaker units detects differences of communication response time from a data input/output section included in the control units to each one of the active speaker units.

4. The in-vehicle communication system of claim 1, wherein the tentative addresses are determined to be not greater than a total number of the active speaker units coupled to the given in-vehicle network and to be in consecutive numbers.

5. The in-vehicle communication system of claim 1, wherein the control unit notifies the active speaker units having the group address of their coupling points in the vehicle and their own tentative addresses as parameters.

6. The in-vehicle communication system of claim 1, wherein at least one audio signal outputting device is coupled to one of the in-vehicle network and the respective plurality of active speaker units, and the control unit includes a microphone and a sound pressure level measuring circuit which extracts an input level of a given frequency band of sound supplied to the microphone.

7. The in-vehicle communication system of claim 6, wherein the control unit receives a given test audio signal reproduced from each one of the active speaker units, and locates the coupling points of the active speaker units based on the sound pressure level extracted by the sound pressure level measuring circuit.

8. The in-vehicle communication system of claim 7, wherein the test audio signal is a signal at a middle and high frequency band.

* * * * *